United States Patent [19]

Tomarin

[11] 4,336,286

[45] Jun. 22, 1982

[54] TENNIS COURT SURFACE WITH SAND TOPDRESSING

[76] Inventor: Seymour A. Tomarin, P.O. Box 730, 23 Smith St., St. Catherines, Ontario, Canada

[21] Appl. No.: 210,542

[22] Filed: Nov. 26, 1980

[51] Int. Cl.[3] ..... A01N 3/00; A41G 1/00

[52] U.S. Cl. ..... 428/17; 428/86; 428/92; 428/95; 428/96; 428/97

[58] Field of Search ..... 428/17, 86, 95, 96, 428/97, 92

[56] References Cited

U.S. PATENT DOCUMENTS

| | | | |
|---|---|---|---|
| 3,995,079 | 11/1976 | Haas | 428/17 |
| 4,044,179 | 8/1977 | Haas | 428/17 |
| 4,061,804 | 12/1977 | McCulloch | 428/17 |

*Primary Examiner*—Marion McCamish

*Attorney, Agent, or Firm*—Cullen, Sloman, Cantor, Grauer, Scott & Rutherford

[57] ABSTRACT

A stabilized sand surface for tennis courts is formed of a thick, densely tufted, coarse, synthetic fiber carpet which is covered with a single layer of fine, dry, silica sand. The carpet tufts each comprise numerous, closely packed, resilient, somewhat twisted strands of substantially equal length, which are tufted to a resilient carpet base sheet so that the strands tend to intertwine, but extend generally upright from the sheet. The sand layer covers the carpet and fills the interstices from the base sheet to substantially the full height or a little below the full height of the strands. The sand covering layer is stabilized by the mat-like network formed of the closely packed, intertwined, resilient strands against substantial permanent shifting or wind loss, while being relatively yieldable under impact of the tennis ball to produce a playing surface which simulates the playing quality of a clay-type tennis court surface.

2 Claims, 6 Drawing Figures

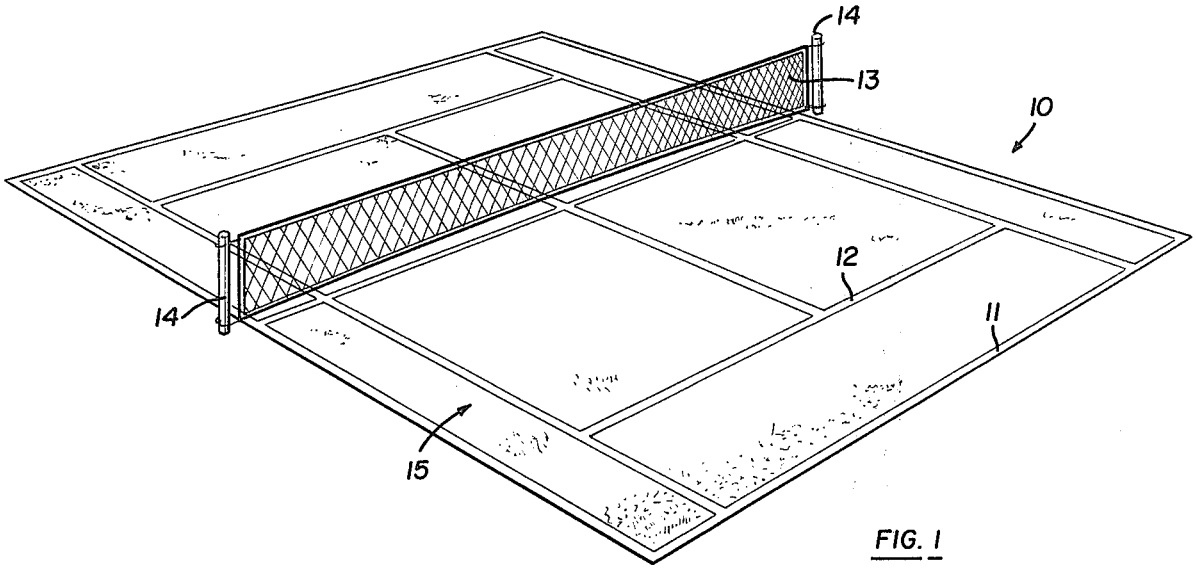
FIG. 1
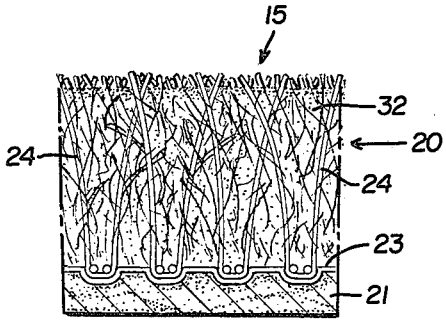
FIG. 2
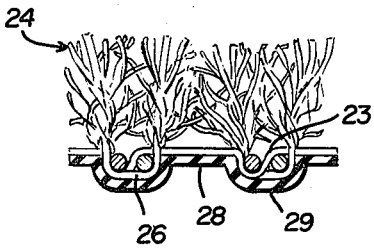
FIG. 3
FIG. 4
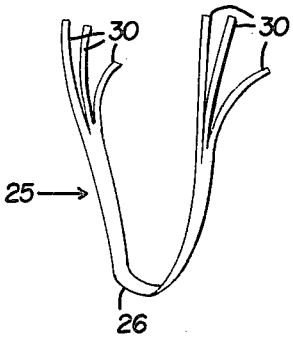
FIG. 5
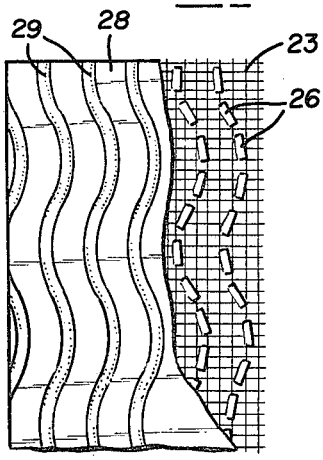
FIG. 6
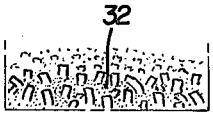

TENNIS COURT SURFACE WITH SAND TOPDRESSING

BACKGROUND OF INVENTION

The invention herein relates to an improved tennis court playing surface. Tennis court surfaces are commonly made of a compacted layer of clay material, or of asphalt, or concrete or the like. Grass or turf surfaces also have been used. But because of the expense and the degree of care required, grass courts have mostly disappeared from use, although still used for certain tennis matches.

Another type of tennis court surface is formed of a synthetic carpet covered with granular material. An example of such a surface is described in U.S. Pat. No. 4,044,179, issued to Haas on Aug. 23, 1977. In this type of court, a flat under-surface or support surface is formed on the ground, usually with suitable drain provisions. Then, the under surface is covered with a so-called "outdoor" synthetic fiber or pile carpet. This, in turn, is covered with layers of granular material which provide, along with the tips of the carpet strands, where same are exposed, a playing surface.

In this type of carpet, the strands or fibers or piles are fastened, either by tufting or by direct fastening, to a base or backing sheet which may be formed of a woven material with or without a rubber-like backing layer, secured to the woven material.

In the synthetic carpet type of playing surface, as described in the above patent, the carpet has been covered by multiple layers of granular material. That is, a fine sand layer is laid directly upon the base sheet, around the strands. A coarse sand layer is applied over the fine sand layer. In addition, a moisture retention material, such as vermiculite or the like, is included either as a separate layer or mixed with the sand, in order to retain a pre-determined amount of moisture to hold the sand against shifting. However, the use of multiple layers, particularly of different grain sizes, and the additional moisture retention materials, increases expenses because of increased difficulty in applying and maintaining the surface for long periods of time, particularly where the court is exposed to extreme changes in weather conditions as is common in many parts of the world where tennis is played.

Thus, the invention herein is concerned with improving the above mentioned type of tennis court surface. More specifically, this invention is concerned with providing a stabilized sand-type of playing surface which is somewhat resilient to provide the ball rebound and speed characteristics that are generally found in clay-type courts, but wherein the application of the sand surface is simplified and the sand is stabilized against permanent shifting or wind blowing.

SUMMARY OF INVENTION

The invention herein contemplates forming a stabilized sand layer tennis court surface formed of a layer of relatively fine, dry, silica sand, resiliently stabilized by a dense, thick, mat-like network of intertwined strands formed by a densely tufted, coarse fiber, synthetic plastic material carpet. The carpet is formed of a resilient sheet base, such as rubber coated woven fabric to which is fastened, such as by tufting, synthetic plastic piles or fibers. The fibers are coarse, relatively slippery and tend to partially intertwine so as to form a dense network whose interstices are filled with the sand.

The dry, fine, sand filled network formed of the resilient fibers, provides a playing surface which closely simulates a clay court type of surface. However, although the improved surface tends to resiliently yield under ball impact, player foot pressure and the like, it is stabilized against permanent shifting of the sand and also against disbursal of the sand by wind blowing conditions. Thus, the surface is easy to apply and to maintain over long periods of time, substantially reducing the need for redistributing or smoothing or otherwise caring for the surface, such as is required for the typical clay-type of courts. Because the mat-like tangled network of fibers is thick and dense, there is a co-action between the network and the sand which stabilizes the complete surface and provides the desired resiliency and surface playing conditions. The ball rebound speed can be adjusted by exposing more or less of the tip portions of the fibers so that these can fold down and momentarily form a slippery surface, under ball sliding impact. This regulates the speed of sliding of the ball upon thesurface. Alternatively, the filling can completely cover the network so that, for all practical purposes, only the sand appears for impacting by the ball.

The invention further contemplates using a plastic fiber material, such as stretch oriented polypropylene extruded strands which are thin, flat, narrow strips and which tend to shred longitudinally in use so that each strand tends to form a plurality of finer strands for better intertangling with each other and the sand.

One object of this invention is to provide an easy to apply court surface which requires minimal maintenance or expensive up-keep and which provides clay-like surface playing characteristics. In keeping with this, the carpet may be formed of strands of appropriate colors to provide the necessary boundary lines and other markings which appear on a tennis court. Because the tips of the strands may be slightly exposed through the sand, the colors of the tightly packed fibers appear to the eye of the user and thus present permanent markings or color upon the court. Consequently, the normal need to mark or replace court lines is eliminated.

These and other objects and advantages of this invention will become apparent upon reading the following description, of which the attached drawings form a part.

DESCRIPTION OF DRAWINGS

FIG. 1 is a perspective view of a conventional tennis court.

FIG. 2 is an enlarged, fragmentary view, of the composite carpet and sand surface material upon the supporting ground surface.

FIG. 3 is an enlarged, fragmentary view, showing the lower portion of the carpet and the attachment of the tufts thereto.

FIG. 4 is an enlarged, perspective view of a U-shaped, bent carpet fiber with split ends.

FIG. 5 is a bottom, plan view of the carpet, partially fragmented.

FIG. 6 is an enlarged, fragmentary view of the upper portion of the surface forming carpet and sand layer.

DETAILED DESCRIPTION

FIG. 1 illustrates a conventional tennis court 10. The court has boundary lines 11, and marker lines 12 to delineate the playing area. Further, a net 13 is stretched between a pair of net posts 14 at the middle of the court. The invention herein relates to the playing surface 15 which forms the court.

The playing surface is formed of a carpet 20 which is rested upon a support base or sub-surface 21. The base normally comprises an appropriately prepared flat, generally unyielding or firm dirt or the like base. That is, the ground is normally flattened, graded for levelness and draining, and prepared with the appropriate drain means to handle rain and the like. The preparation of the base of the court forms no part of this invention and thus, is shown schematically as the ground 21 in FIG. 2.

Upon the ground or base 21, the carpet is laid so that it is flat and ordinarily, tilted or angled to the horizontal a slight amount to provide good drainage therefrom.

The carpet is made of a woven, cloth, backing sheet 23, such as of plastic, woven fibers of polypropylene, nylon or the like. The specific kind of cloth is of no concern here, so long as it is of a material which performs the function described and will stand up to the ambient weather conditions.

Secured to the woven cloth backing sheet 23 are numerous tufts 24 which are densely packed together, i.e., closely secured relative to each other, to the backing sheet. These tufts are formed of numerous individual strands or fibers 25 which are of a synthetic plastic material, as for example, commercially available, stretch oriented, isotactic polypropylene or the like.

The strands or fibers are double bent into a U-shaped configuration to provide a bight 26, as illustrated in FIGS. 3 and 4. A large number of strands are held together into the tuft shape, as for example, a dozen fibers which are double bent to thereby provide two dozen strands or piles. Each of the U-shaped halves or legs or piles may be on the order of about one-half inch to two inches in length and preferably, approximately one inch in length for good results.

The fibers tufts may vary in exact size and thickness, for example, on the order of about 5700 to 7600 denier. Preferably, each fiber is considerably wider than it is thick, such as 1½ to 2 mils thick and about 1/16" in width to form a paper thin, narrow strip. These strips are resilient to a considerable degree because of the nature of synthetic plastic and particularly the kind mentioned above. Moreover, the fibers tend to tangle and partially intertwine with each other to form a tangled, dense network or mass.

The tufts themselves are closely arranged upon the backing sheet and may be threaded through the backing sheet so that the tuft bights 26 are held in the backing sheet. Placing the tufts closely together, such as roughly an eighth of an inch apart in one direction and roughly a quarter of an inch apart in the opposite direction, tightly packs them together to form the dense network or mass required here. The carpet formed with these tufts is roughly between about 24-36 oz. per square yard in weight.

Referring to FIGS. 3 and 5, the bottom surface of the woven backing sheet is preferably covered with the thin coating of monolithic, rubber-like material which provides a rubberized, protective undersurface to rest upon the ground. Because the rubber-like coating is relatively thin, i.e., in the order of less than 1/32 of an inch, for example, welts or beads are formed around the bight portions of the tufts which extend beneath the woven backing sheet. These tread welts or beads tend to align into rows to form tread-like formations 29 or separate downwardly extending bumps or protrusions. These downwardly extending enlargements function to grip into the ground surface to better hold the carpet against transversely slipping thereon.

The individual fibers or strands, as illustrated in FIG. 4, are paper-like in thickness, but relatively wide, such as, for example, in the order of a sixteenth of an inch. If formed of a stretch oriented polypropylene, or the like, the fibers have a tendency to split at their ends and to partially sever to form a plurality of relatively curled or tangled end portions 30 on each fiber. This increases the intertwining and resilient curliness of the fibers.

Once the carpet is laid upon the support, a coating layer of silica sand is applied thereon. The sand is of a fine grain, such as on the order of between about 40–50 U.S. mesh in grain size. The sand, which is substantially dry, is evenly deposited upon the carpet and smoothed out to the approximate depth equivalent to the height of the strands. That is, the sand covering or layer may be as deep as the height of the carpet or slightly less to expose tip portions of the strands.

Referring to FIGS. 1 and 6, the sand covering 32 fills the interstices within the tangled network of fibers or strands. The composite tangled fiber mass and sand particles together form a somewhat resilient, thick surface layer, of sufficient resiliency to handle the usual ball impact and player foot impact which is applied to tennis court surfaces. Because of the fiber network caused resiliency, the layer tends to give and return to its normal original shape. That is, the sand is stabilized against permanently shifting. It is also stabilized against blowing away under heavy wind conditions during dry weather.

When the sand covering layer is at the upper plane of the carpet, the ball strikes the sand and bounds off it or slides upon it, in the same general manner as the ball reacts to a clay-type court. However, the court can be made "faster" by reducing the height of the sand somewhat, so that a small portion of the tips of the strands remain exposed. Thus, when the ball strikes and slides upon the surface, the strand tips contacting the ball tend to bend down and get between the ball and the sand, to thereby provide a slippery surface portion which momentarily permits the ball to slide faster. Once the ball departs from that point, the tip portions of the strands tend to straighten out or return to their normal position. Slight variences in the amount of tip exposure can provide either a faster or slower court for the ball.

In order to reduce the maintenance required, the lines 11 and 12 can be formed of fibers and tufts which are of a different color than the remainder of the carpet tufts. Thus, the lines are permanently formed within the carpet and no line maintenance is required.

Similarly, maintenance of the sand covering is substantially reduced since the sand layer thickness tends to remain constant for long periods of time due to the stabilization by the tangled network produced by the composite of the carpet fibers and the sand. To the extent that replenishment of sand may become necessary, it becomes relatively simple to apply and rake a pile of sand of a single general mesh size, over the surface portions where it is required. Thus, the prior usage of multiple layers of different kinds of sands or other granular materials including moisture retention materials, is eliminated by the composite carpet network and fine grain sand of this invention.

Moreover, the use of a single layer of roughly equal size sand particles reduces the compacting which occurs when smaller particles are mixed with a layer of larger particles. Thus, draining is improved with single size particles.

Having fully described an operative embodiment of this invention, I now claim:

1. A stabilized sand surface for a tennis court formed of a synthetic pile carpet laid upon a flat, support surface, and covered with a granular material, comprising:

said pile carpet being formed of relatively thick, substantially equal length strands being of a synthetic fiber of between about one-half to two inches in length, with each of said strands being fastened at its lower end to a relatively resilient, generally flat carpet base sheet, and extending upright therefrom, and with the strands being densely packed together, with adjacent strands generally tending to partially intertwine together, to form a thick, dense, mat-like network, each of said strands being narrow, flat, strip-like, of substantially uniform cross-section, and having a width which is many times greater than the fiber thickness, and each of said strands having a plurality of side-by-side end portions to increase the intertwining with adjacent strands, said strands being formed of U-shaped, double bent, lengths of fibers which are clustered together into tufts, each comprising a substantial number of fibers per tuft, which are secured through the base sheet and wherein the lower surface of said base sheet includes a coating of a rubber-like material for providing a resilient base surface, and with the bights of the U-shaped, bent fibers being relatively thinly covered with the rubber-like base sheet coating to provide downwardly protruding treadlike formations on the lower surface of the carpet to thereby resist sliding movement of the carpet upon the support surface;

a uniform thickness coating of substantially dry, fine, silica sand, such as in the range of about 40–50 mesh size, covering the carpet base sheet, and the strands, with the coating being of a pre-selected height of between the free ends of the strands to a short distance beneath said free ends for exposing a pre-determined length portion of the tips of said free ends;

and said sand coating filling the interstices between the closely adjacent strands, whereby the mat-like network resiliently stabilizes the sand coating against permanently shifting under ball impact and wind blowing.

2. A tennis court surface as defined in claim 1, and said strands being formed of a relatively thick, e.g., roughly 1½ to 2 mils thick, narrow strips of polypropylene, to form a roughly between about 24–36 oz. per square yard weight of carpet.

* * * * *